US007227094B2

(12) United States Patent
Oexle et al.

(10) Patent No.: US 7,227,094 B2
(45) Date of Patent: Jun. 5, 2007

(54) METHOD FOR PROCESSING FLAT DELIVERIES IN DELIVERY CONTAINERS

(75) Inventors: Dietmar Oexle, Singen (DE); Rolf Peter Skrdlant, Konstanz (DE)

(73) Assignee: Siemens AG, Munich (DE)

( * ) Notice: Subject to any disclaimer, the term of this patent is extended or adjusted under 35 U.S.C. 154(b) by 265 days.

(21) Appl. No.: 10/497,295

(22) PCT Filed: Sep. 26, 2003

(86) PCT No.: PCT/DE03/03210

§ 371 (c)(1),
(2), (4) Date: May 28, 2004

(87) PCT Pub. No.: WO2004/030836

PCT Pub. Date: May 14, 2004

(65) Prior Publication Data

US 2005/0067329 A1 Mar. 31, 2005

(30) Foreign Application Priority Data

Sep. 30, 2002 (DE) ..... 102 45 873

(51) Int. Cl.
*B07C 5/00* (2006.01)

(52) U.S. Cl. ..... 209/584; 209/900

(58) Field of Classification Search ..... 209/3, 209/3.3, 583, 584, 900; 198/370.03

See application file for complete search history.

(56) References Cited

U.S. PATENT DOCUMENTS

| | | | | |
|---|---|---|---|---|
| 5,385,243 | A | 1/1995 | Jackson et al. | 209/509 |
| 5,470,427 | A * | 11/1995 | Mikel et al. | 156/387 |
| 2002/0125177 | A1 | 9/2002 | Burns et al. | 209/630 |
| 2004/0159592 | A1 * | 8/2004 | McLaughlin et al. | 209/584 |
| 2005/0173312 | A1 * | 8/2005 | Hanson | 209/584 |

FOREIGN PATENT DOCUMENTS

| | | | |
|---|---|---|---|
| DE | 199 47 259 | C1 | 9/1999 |
| EP | 0 495 661 | A2 | 1/1992 |
| EP | 053463 6 | A1 * | 3/1993 |
| EP | 0 595 596 | A2 | 10/2003 |
| WO | WO 00/53344 | | 9/2000 |

* cited by examiner

*Primary Examiner*—Joseph C. Rodriguez

(57) ABSTRACT

A method for processing a batch of mail wherein a mail sorting machine sorts the batch of mail to a plurality of sorting bins according to a predetermined sorting plan includes steps of reading an identification code from an empty mail tray, loading the empty tray in a buffer storage unit associated with one of the sorting bins, activating a switch associated with the buffer storage unit to confirm that the mail tray is positioned in the buffer, assigning the tray identification code to a destination associated with the sorting bin in the sorting plan, and then sorting mail to the sorting bin and transferring sorted mail from the sorting bin into the mail tray.

19 Claims, 1 Drawing Sheet

METHOD FOR PROCESSING FLAT DELIVERIES IN DELIVERY CONTAINERS

TECHNICAL FIELD

The invention relates to a method for processing mail pieces.

BACKGROUND OF THE INVENTION

In the known sorting machine, trays without fixed identification marks are used. After the end of the sorting operation, the mail pieces are transferred from the sorting bins of the sorting machine into the trays which are provided in buffer storage units assigned to the sorting bins, and the concluded transfer operation is acknowledged for the respective sorting bin by means of key actuation. As a result, by means of a label printer, a label with the current destination address is printed out in coded and/or readable form for this sorting bin or with an identification label and is attached to the container by the operator. The requirement for an identification label automatically involves assignment between the identification label and the destination address, this assignment being filed in the control and being available for further identification. This solution does not allow the expedient use of trays with fixed identification marks in the mail handling process, since it is not possible for these identification marks to be coupled to the destination addresses on the basis of the abovementioned technology.

SUMMARY OF THE INVENTION

The object on which the invention is based is to provide a generic method, in which fixed identification marks of trays, into which the mail pieces are transferred from the sorting bins of the sorting machine, are assigned to the variable destination addresses of the sorting bins at low outlay and reliably, so that the identification marks can be utilized for further process steps after sorting, for example the automatic attachment of a label or tie-up to a tray management system.

For each buffer storage unit belonging to a sorting bin, a confirmation element for the presence of a tray is provided. After a filled tray has been discharged from the respective buffer storage unit and after the confirmation element has at the same time been reset to the empty state, an empty tray is reloaded into this buffer storage unit. As a result of a signal triggered in this case from the confirmation element, the identification mark belonging to the tray and previously read by a reading device is assigned to the destination address for the destination address area allocated to this sorting bin by the current sorting plan and is stored. By means of this procedure, the identification marks of the trays, for example in the form of RFID labels, are reliably assigned to the current destination addresses of the respective sorting bin, without each sorting bin needing to possess a reader for identification marks.

Thus, it is advantageous that the reading device be blocked, after the reading of the identification mark until the next confirmation signal relating to the presence of a tray is triggered. This prevents the situation where, when several operators use one reading device together, the correct assignment of the identification mark to the destination address is lost. It is also advantageous to provide as a confirmation element a presence sensor for trays in the buffer storage unit. A corresponding presence signal is thereby triggered automatically. In a further design variant for confirmation elements, a switching element to be actuated by the operator is located at the buffer storage unit or at the assigned sorting bin. This ensures semiautomatic operation, in which case the operator can take into account the degree of filling of the tray in the supply and discharge of these.

Advantageously, the sorting machine also has a fully automatic or semiautomatic supply device for empty trays.

Advantageously, one or more supply stations equipped in each case with a reading device for the identification marks of the tray are provided for the empty trays. When the trays are supplied for the entire sorting machine or for specific areas, the reading of the respective identification marks also takes place. It is consequently possible to keep the walking distances of the operators short.

To ensure the reliable assignment of the identification marks even in the event of the change from one sorting run with an associated sorting plan to the next sorting run with an associated sorting plan, in a further advantageous refinement, after the last delivery of the previous sorting run has been sorted according to the associated sorting plan, for the mail pieces to be sorted in the next sorting run the sorting bins are assigned to the destination addresses according to the sorting plan of the next sorting run, so that, for example using separating cards, the next sorting run can be commenced without interruption.

When all the mail pieces of a sorting bin of the previous sorting run are transferred, the tray for these mail pieces is removed from the buffer storage unit and a new empty tray for the mail pieces of the new sorting run is placed, after the reading of its identification mark, in the respective buffer storage unit. The corresponding switching element is then actuated twice in succession, as a result of the first actuation the presence of the tray in the buffer storage unit being signaled, and as a result of the second actuation the change of the assignment of the identification mark to the new destination address taking place.

It is advantageous, furthermore, if, at each sorting bin, a signal generator is located, which is switched on by virtue of the correct actuation of the switching element during the loading of the buffer storage unit and is switched off automatically, by a presence sensor located in each buffer storage unit, during the removal of the tray from the buffer storage unit. The operator can thereby recognize the switching and assignment state and avoid errors.

BRIEF DESCRIPTION OF THE DRAWING

The invention is explained in more detail below in an exemplary embodiment, with reference to the drawing in which.

DETAILED DESCRIPTION

Figure 1:
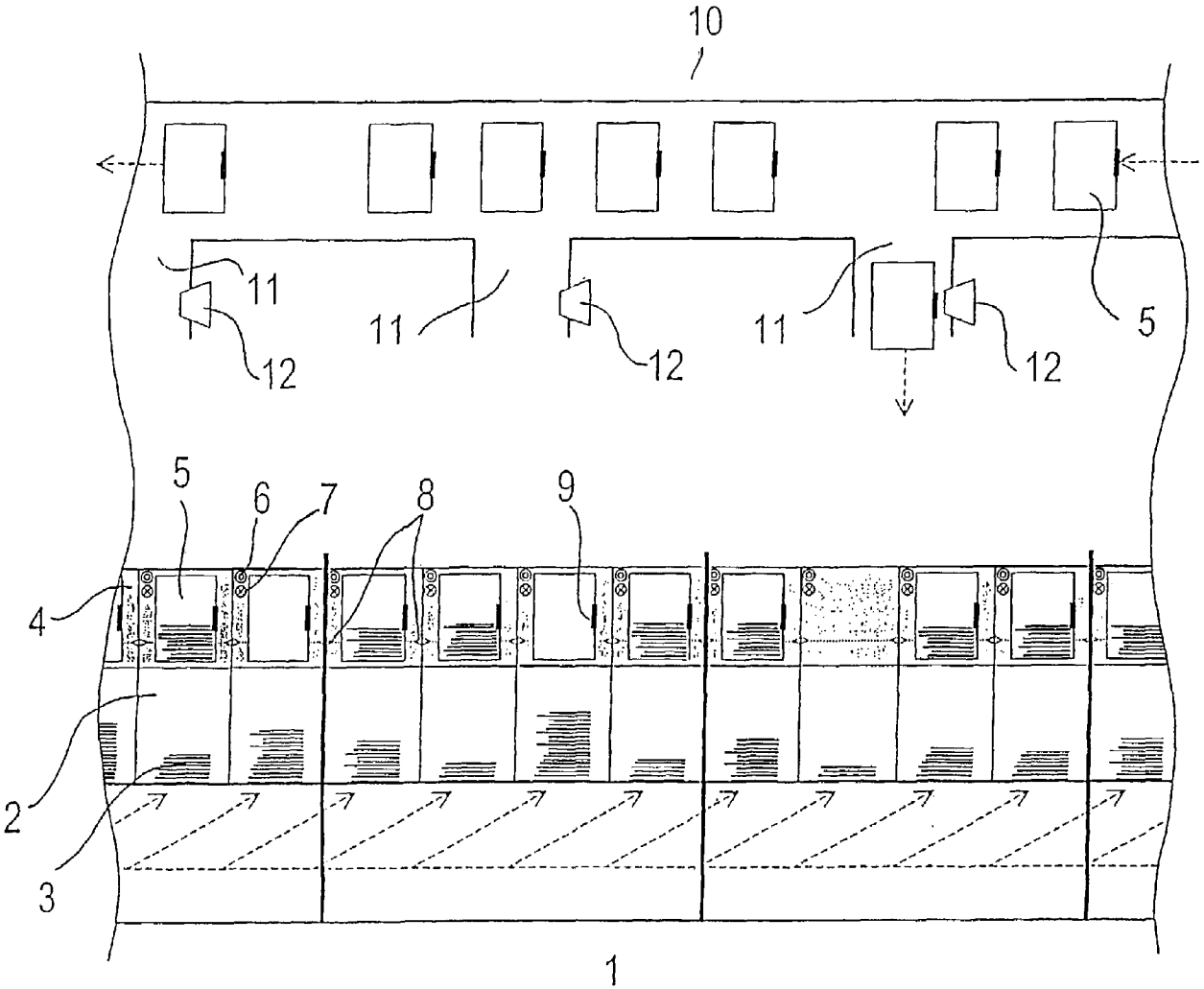
FIG. 1 shows a diagrammatic top view of a sorting machine.

As may be gathered from FIG. 1, located next to one another along a sorting machine 1 are sorting bins 2, into which the mail pieces 3 are sorted, standing on their narrow sides, according to destination addresses in conformity with a sorting plan. The sorting bins 2 are designed as sorting compartments, at the stacking point of which the mail pieces enter the stacking compartment and are held in the vertical position by a stack support, not illustrated, which can be displaced away from the stacking point according to the stack size counter to a spring force. Each sorting bin 2 has belonging to it a buffer storage unit 4 which receives a mail tray 5 with a fixed identification mark 9 and into which the mail pieces 3 are transferred from this sorting bin 2 when the sorting bin 2 is correspondingly filled. The buffer storage units 4 are normally located below the sorting bin 2 and are drawn forward solely for the transfer operations and for re-equipping with mail trays 5, on telescopic rails into the position illustrated for all the sorting bins 2 in the drawing for a clearer explanation. Located in the region of each sorting bin 2 is a switching element 6 (designed as a key) and a signal generator 7, (designed as a luminous element) which indicates whether the switching element 6 has been properly actuated. Within the buffer storage unit 4 is arranged a presence sensor 8 (designed as a light barrier) which detects whether a tray 5 is located in the buffer storage unit 2 or not. Arranged parallel to the sorting bin 2, at a distance which leaves sufficient space for the operators, is a supply device 10 for empty trays 5 with a plurality of supply stations 11. Each supply station 11 has a reading device 12 for the identification marks 9 of the trays 3. These identification marks 9 may be both optically readable bar codes and RFID tags.

The number of supply stations 11 is defined as a function of the number of sorting bin 2, in such a way that the operator or operators have to cover as short distances as possible. In this example, each supply station 11 with the reading device 12 is assigned an area with four sorting bins 2. A further reason for division is to safeguard the assignment of the read identification mark 9 and station 2 or the corresponding destination address. In order to guarantee this, the sorting bins and the associated reading devices 12 are also assigned to specific operators. In the case of overlapping assignments, that is to say two operators are competent for one area, after the reading of an identification mark 9, the reading device 12 is blocked until the next confirmation signal relating to the new presence of a tray 5 in a sorting bin 2 of this area is triggered.

During a sorting run, the mail pieces 3 are sorted into the sorting bins 2. Where a sorting bin 2 is approximately ⅔ full, the respective buffer storage unit 4 is drawn out, and the mail pieces 3 are transferred from the sorting bin 2 into the tray 5 in the buffer storage unit 4. The tray 5 is then removed. Triggered by the change of signal from the presence sensor 8, the signal generator/luminous element 7 is extinguished. The operator then extracts an empty tray 5 from the supply device 10 at the corresponding supply station 11, allows the identification mark 9 to be read by the reading device 12 and places said container into the empty buffer storage unit 4 in which the signal generator 7 signals container absence. It subsequently actuates the switching element 6, with the result that the signal generator 7 emits a luminous signal again and at the same time the identification mark 9 of this tray 5 is assigned to the destination address which has been allocated to this sorting bin 2 by the active sorting plan.

In order to avoid unnecessary standstill times in the sorting machine 1, after the sorting of the last delivery 3 of the previous sorting run, separating cards are introduced into the sorting bin 2, said separating cards identifying the last delivery 3 in each sorting bin 2, and the next sorting run is commenced without interruption. For this purpose, a change from the destination addresses according to the sorting plan of the previous sorting run which were allocated to the sorting bins 2 to the destination addresses according to the sorting plan of the new sorting run takes place. However, this assignment change with respect to the identification marks 9 of the trays 5 for each sorting bin 2 is carried out only when all the mail pieces 3 of the previous sorting run at the sorting bin 2 have been transferred into a tray 5 and this tray 5 has been removed. After the new empty tray 5 has been extracted from the supply station 11 after the reading of the identification mark 9 and has been placed into the respective buffer storage unit 4, the respective switching element 6 is actuated twice in succession.

The first actuation signals the presence of the tray 5 just read in the buffer storage unit 4 and the second actuation results in the new allocation of this sorting bin 2 to the destination address according to the sorting plan of the new sorting run. This is carried out until all the sorting bins are worked through. When no delivery 3 has been sorted into a specific sorting bin 2 during a sorting run, the sorting bin 2 and associated tray 5 are empty. In this case, the signal generator 7 still lights up and the switching element 6 has to be actuated once only in order to carry out the change to the new sorting plan.

The invention claimed is:

1. A method for processing mail pieces with the aid of a sorting machine that sorts the mail pieces to a number of bins, each bin having a buffer storage unit at or below each sorting bin for holding a tray, comprising:

(a) loading mail pieces that have been sorted to a bin from the bin into a tray positioned on the buffer storage unit for that bin;

(b) discharging the tray loaded with mail from the buffer storage unit;

(c) reading an identification code on an empty tray with a reading device;

(e) reloading the empty tray onto the buffer storage unit;

(f) activating a confirmation element upon arrival of the empty tray at the buffer storage unit, which confirmation element triggers a confirmation signal;

(g) assigning a destination address or destination address area allocated to the sorting bin identified by the signal to the identification code on the tray; and (h) storing the assigned identification code in the sorting machine for use by the current sorting plan; and (I) repeating steps (a) to (h) for additional sorting bins as each bin becomes loaded with mail by the sorting machine.

2. The method as claimed in claim 1, further comprising blocking the reading device from reading another identification code after reading of the identification code until the next confirmation signal indicating presence of a tray is triggered.

3. The method as claimed in claim 1, further comprising resetting the confirmation element to an empty state after discharging of a loaded tray from the buffer storage unit.

4. The method as claimed in claim 1, wherein the confirmation element comprises a tray presence sensor.

5. The method as claimed in claim 1, wherein the confirmation element comprises a switch actuated by an operator at the buffer storage unit or at the assigned sorting bin.

6. The method as claimed in claim 1, further comprising supplying empty trays from an automated tray supply station.

7. The method as claimed in claim 6, further comprising supplying empty trays from two or more automated tray supply stations assigned to specific sorting bin areas and each equipped with a reading device for the identification marks used in step (c).

8. The method as claimed in claim 5, further comprising, after a last delivery of a previous sorting run has been sorted according to the associated sorting plan:

allocating sorting bins for a new sorting plan for the mail pieces of the next sorting run to be sorted;

when all the mail pieces of a sorting bin of the previous sorting run have been transferred to a tray, removing the tray with these mail pieces from the buffer storage unit;

placing a new empty tray for mail pieces of the new sorting run, after the reading of its identification mark, in the respective buffer storage unit; and actuating the switch for that buffer storage unit twice in succession, first as a result of the presence of the new tray in the buffer storage unit being signaled, and second to signify the change of the assignment of the identification mark to a new destination address for the new sorting run.

9. The method as claimed in claim 5, wherein a signal generator is located at each storage bin, further comprising:

switching on the signal generator using the switch during loading of the buffer storage unit; and switching the signal generator off automatically using a presence sensor located in each buffer storage unit, which sensor detects removal of the tray from the buffer storage unit.

10. A method for processing a batch of mail wherein a mail sorting machine sorts the batch of mail to a plurality of sorting bins according to a predetermined sorting plan, comprising:

(a) reading an identification code from an empty mail tray;

(b) loading the empty tray in a buffer storage unit associated with one of the sorting bins;

(c) activating a switch associated with the buffer storage unit to confirm that the mail tray is positioned in the buffer;

(d) assigning the tray identification code to a destination associated with the sorting bin in the sorting plan;

(e) sorting mail to the sorting bin;

(f) transferring sorted mail from the sorting bin into the mail tray; and (g) removing the mail tray from the storage buffer unit.

11. The method of claim 10 wherein the identification code is read with a reading device, the method further comprising blocking the reading device after the reading the identification code from the mail tray until the next activation of the switch associated with the buffer storage unit.

12. The method of claim 10 further comprising resetting the switch to an empty position when the mail tray is removed from the buffer storage unit.

13. The method of claim 10 wherein the switch comprises a sensor associated with the buffer unit that senses the presence of a mail tray in the buffer.

14. The method of claim 10 wherein the switch is connected to a signal generator, the method further comprising generating a signal indicating that the mail tray is in the buffer storage unit.

15. The method of claim 10 wherein the switch is a manually activated device associated with the buffer storage unit.

16. The method of claim 15 wherein the switch is connected to a signal generator, the method further comprising generating a signal indicating that the mail tray is in the buffer storage unit.

17. The method of claim 10, wherein the sorting machine includes a supply device for supplying empty trays.

18. The method of claim 17, wherein at least one supply station is assigned to a specific sorting bin area and equipped with a reading device for reading the identification codes of mail trays provided to the supply station.

19. The method of claim 10 wherein the identification code is one of a bar code or RFID label permanently attached to the mail tray.

* * * * *